US006519921B1

(12) United States Patent
Tsuruda et al.

(10) Patent No.: US 6,519,921 B1
(45) Date of Patent: Feb. 18, 2003

(54) COIN WRAPPING MACHINE

(75) Inventors: Mitsumasa Tsuruda, Saitama (JP); Nobushige Horiguchi, Saitama (JP); Shoichi Uda, Tokyo (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/543,541

(22) Filed: Apr. 5, 2000

(30) Foreign Application Priority Data

Apr. 8, 1999 (JP) ..... 11-100891

(51) Int. Cl.[7] ..... B65B 11/00; B65B 1/30

(52) U.S. Cl. ..... 53/501; 53/504; 53/210; 53/211; 53/212

(58) Field of Search ..... 53/501, 504, 210, 53/211, 212; 453/31, 32, 30, 58, 59, 61

(56) References Cited

U.S. PATENT DOCUMENTS

| | | | | |
|---|---|---|---|---|
| 3,821,917 | A | | 7/1974 | Hatanaka |
| 3,908,338 | A | | 9/1975 | Ushio |
| 4,123,892 | A | | 11/1978 | Asami |
| 4,729,211 | A | * | 3/1988 | Sakurai |
| 4,896,481 | A | * | 1/1990 | Sentoku et al. |
| 4,897,984 | A | * | 2/1990 | Sentoku et al. |
| 5,105,601 | A | * | 4/1992 | Horiguchi et al. |
| 5,499,483 | A | * | 3/1996 | Oikawa |
| 5,970,683 | A | * | 10/1999 | Miyamoto et al. |
| 6,209,294 | B1 | * | 4/2001 | Hibari |

FOREIGN PATENT DOCUMENTS

| | | |
|---|---|---|
| EP | 0 849 712 | 6/1998 |
| JP | 10-230905 | 9/1998 |

* cited by examiner

*Primary Examiner*—Eugene Kim
(74) *Attorney, Agent, or Firm*—Cohen, Pontani, Lieberman & Pavane

(57) ABSTRACT

A coin wrapping machine includes a rotatable disk for feeding coins toward a coin passage by centrifugal force produced by the rotation thereof, a disk motor for rotating the rotatable disk, a transporting belt for transporting the coins along the coin passage, a belt motor for driving the transporting belt, a coin stacker, a coin wrapping device having a plurality of wrapping rollers, a wrapping roller motor for driving the wrapping rollers, a pair of crimp claws, a crimp claw motor for moving the pair of crimp claws, and a driving speed controller for controlling the disk motor, the belt motor, the wrapping roller motor and the crimp claw motor based on the denomination of the predetermined coins. According to this coin wrapping machine, it is possible to stack and wrap coins having different shapes, diameters, thickness and the like efficiently and as desired.

20 Claims, 6 Drawing Sheets

COIN WRAPPING MACHINE

BACKGROUND OF THE INVENTION

The present invention relates to a coin wrapping machine and, particularly, such a machine which can stack and wrap coins having different shapes, diameters, thickness and the like efficiently and as desired.

DESCRIPTION OF THE PRIOR ART

Japanese Patent Application Laid Open No. 10-230905 discloses a coin wrapping machine comprising a rotatable disk for feeding out coins deposited into the coin wrapping machine one by one to a coin passage, a discriminating and counting means disposed in the coin passage for discriminating whether or not coins are acceptable and the denominations of the coins and counting coins, a coin stacking section having a pair of stacking drums for stacking a predetermined number of coins therein, a plurality of wrapping rollers for winding a wrapping material around coins stacked in the coin stacking section, and a pair of upper and lower crimp claws for crimping upper and lower edge portions of the wrapping material wound around the stacked coins, the rotating speed of the wrapping rollers and the moving speed of the crimp claws being adjustable in accordance with the denomination of coins to be wrapped.

In this coin wrapping machine, coins fed onto the rotatable disk are fed one by one into the coin passage by the centrifugal force produced by the rotation of the rotatable disk and whether or not coins are acceptable and the denomination of coins are discriminated, and the number of coins is counted by the discriminating and counting means. The coins are then fed into the coin stacking section and stacked between the pair of stacking drums as the pair of stacking drums are rotated. The thus stacked coins are delivered to a location among the plurality of wrapping rollers and held between the plurality of wrapping rollers. The wrapping rollers are rotated so as to rotate the stacked coins while the wrapping material is fed to a location between the wrapping rollers and the stacked coins, whereby the wrapping material is wound around the stacked coins. Afterward, the pair of crimp claws is actuated so as to crimp the upper and lower edge portions of the wrapping material, thereby producing a wrapped coin roll.

This coin wrapping machine is further provided with a speed setting means for setting the rotating speed of the wrapping rollers and the moving speed of the crimp claws in accordance with the denomination of coins to be wrapped so that not only circular coins but also polygonal coins can be wrapped. More specifically, in the case where the wrapping rollers are rotated for wrapping polygonal coins at the same speed as that for wrapping circular coins, when stacked polygonal coins are rotated between the plurality of wrapping rollers, the contact pressure between the stacked coins and the circumferential surfaces of the plurality of wrapping rollers in contact therewith varies due to the ups and downs on the circumferential surfaces of the polygonal coins, whereby the stacked coins are sometimes vibrated out of their proper orientation to the point of flying out between the wrapping rollers. Therefore, in order to prevent stacked polygonal coins from being vibrated, this coin wrapping machine is constituted so that when stacked polygonal coins are to be wrapped, the rotating speed of the wrapping rollers is set lower than when circular coins are to be wrapped.

However, in this coin wrapping machine, since the rotating speed of the rotatable disk, the transporting speed of transporting belt and the rotating speed of the pair of stacking drums are fixed even for coins having different shapes, diameters, thickness and the like, coins sometimes cannot be stacked in the coin stacking section in a desired manner and, therefore, it is sometimes difficult to efficiently and desirably wrap stacked coins.

More specifically, if the rotating speed of the rotatable disk is constant for coins having small diameters, since a greater number of coins are fed into the coin passage per unit time as compared with coins having large diameters, coin jamming sometimes occurs so that coins cannot be stacked in the coin stacking section in a desired manner. On the other hand, in the case where coins having large diameters are stacked, since the coin weight is great, if coins are transported in the coin passage by the transporting belt at the same speed as that for small coins, they sometimes cannot be stacked between the pair of stacking drums in the coin stacking section due to their inertia force and, therefore, cannot be stacked in a desired manner. Further, in the case where thicker coins are stacked, since the amount of rotation of the pair of stacking drums required for stacking one coin becomes great, if the transporting speed of the transporting belt is the same as that for thin coins, coin jamming sometimes occurs between the pair of stacking drums. Moreover, in the case where the rotating speed of the wrapping rollers is set lower than when circular coins are to be wrapped as in the conventional coin wrapping machine when stacked polygonal coins are wrapped, if the transporting speed of the transporting belt is the same as that for circular coins, coin jamming sometimes occurs between the pair of stacking drums.

SUMMARY OF THE INVENTION

It is therefore an object of the present invention to provide a coin wrapping machine which can stack and wrap coins having different shapes, diameters, thickness and the like efficiently and as desired.

The above and other objects of the present invention can be accomplished by a coin wrapping machine comprising denomination setting means for setting a denomination of coins to be wrapped, a rotatable disk for feeding coins toward a coin passage by centrifugal force produced by the rotation thereof, rotatable disk driving means for rotating the rotatable disk, transporting belt means for transporting the coins fed into the coin passage by the rotatable disk along the coin passage, transporting belt driving means for driving the transporting belt means, counting means disposed in the coin passage for counting the number of coins having the denomination set by the denomination setting means, and coin stacking means for stacking a predetermined number of coins whose number has been counted, said coin wrapping machine further comprising coin wrapping means comprising a plurality of wrapping rollers for holding the coins stacked by the coin stacking means therebetween and rotating them around their longitudinal axis to wind a wrapping material around a circumferential surface of the coins stacked by the coin stacking means, wrapping roller driving means for driving the wrapping rollers, a pair of crimp claw means for approaching the coins stacked by the coin stacking means and around which the wrapping material is wound from upper and lower locations and crimping upper and lower edge portions of the wrapping material, crimp claw means driving means for moving the pair of crimp claw means, and driving speed control means for controlling the rotatable disk driving means, the transporting belt driving means, the wrapping roller driving means and the crimp claw means driving means based on the denomination of the coins set by the denomination setting means, thereby controlling the rotating speed of the rotatable disk, the driving speed of the transporting belt means, the rotating speed of the wrapping rollers and the moving speed of the crimp claw means driving means.

According to the present invention, the rotation speed of the rotatable disk and the driving speed of the transporting belt means can be controlled in accordance with the diameters of coins. Therefore, in the case where the diameter of coins is small, it is possible to prevent feed-out of such a large number of coins into the coin passage that the coins jam in the coin stacking section, and in the case where the diameter of coins are large and the coin weight is great, it is possible to prevent the coins from failing to be stacked at a portion between the pair of stacking drums in the coin stacking section due to their inertia force. Further, according to the present invention, the rotation speed of the rotatable disk and the driving speed of the transporting belt means can be controlled in accordance with the thickness of coins. Therefore, in the case where coins are thick and the amount of rotation of the pair of stacking drums required for stacking one coin is great, it is possible to prevent coins from jamming at a portion between the pair of stacking drums, and in the case where coins are thin and the amount of rotation of the pair of stacking drums required for stacking one coin is small, the handling efficiency of coins can be improved. Moreover, according to the present invention, the rotation speed of the rotatable disk, the driving speed of the transporting belt means, the rotation speeds of the wrapping rollers and the moving speeds of the crimp claw means can be controlled in accordance with shapes of coins to be wrapped. Therefore, in the case where stacked polygonal coins are wrapped, it is possible not only to prevent coins from jamming between the pair of stacking drums but also to prevent the stacked coins from getting out of proper orientation during the wrapping operation and flying out from between the wrapping rollers.

In a preferred aspect of the present invention, the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are smaller than a reference coin having a predetermined diameter and a predetermined thickness.

According to this preferred aspect of the present invention, in the case where coins of the denomination set by the denomination setting means are smaller than the reference coin having a predetermined diameter and a predetermined thickness, since the rotating speed of the rotatable disk and the driving speed of the transporting belt means are controlled to be lower than the reference driving speeds, it is possible to efficiently prevent a greater number of coins from being fed into the coin passage and coins from jamming in the coin stacking section.

In another preferred aspect of the present invention, the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are larger than a reference coin having a predetermined diameter and a predetermined thickness.

According to this preferred aspect of the present invention, in the case where coins of the denomination set by the denomination setting means are larger than the reference coin having a predetermined diameter and a predetermined thickness, since the rotating speed of the rotatable disk and the driving speed of the transporting belt means are controlled to be lower than the reference driving speeds, it is possible to reliably prevent large diameter coins having great weight from failing to be stacked between the pair of stacking drums in the coin stacking section due to their inertia force.

In a further preferred aspect of the present invention, the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are thicker than a reference coin having a predetermined diameter and a predetermined thickness.

According to this preferred aspect of the present invention, in the case where coins of the denomination set by the denomination setting means are thicker than the reference coin having a predetermined diameter and a predetermined thickness and the amount of rotation of the pair of stacking drums required for stacking one coin is great, since the rotating speed of the rotatable disk and the driving speed of the transporting belt means are controlled to be lower than the reference driving speeds, it is possible to efficiently prevent coins from jamming between the pair of stacking drums.

In a further preferred aspect of the present invention, the driving speed control means is adapted to control the rotatable disk driving means and the transporting belt driving means so that the rotating speed of the rotatable disk and the driving speed of the transporting belt means are higher than reference driving speeds when coins of the denomination set by the denomination setting means are thinner than a reference coin having a predetermined diameter and a predetermined thickness.

According to this preferred aspect of the present invention, in the case where coins of the denomination set by the denomination setting means are thinner than the reference coin having a predetermined diameter and a predetermined thickness and the amount of rotation of the pair of stacking drums required for stacking one coin is small, since the rotating speed of the rotatable disk and the driving speed of the transporting belt means are controlled to be higher than the reference driving speeds, the handling efficiency of coins can be improved.

In a further preferred aspect of the present invention, when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

According to this preferred aspect of the present invention, in the case where coins of the denomination set by the denomination setting means are polygonal, the rotating speed of the rotatable disk and the driving speed of the transporting belt means are controled to be lower than reference driving speeds and the rotating speed of the wrapping rollers and the moving speed of the crimp claw means are controlled to be lower that reference speeds. Therefore, it is possible to reliably prevent coins from jamming between the pair of stacking drums and also to prevent the stacked coins from being vibrated due to ups and downs on the circumferential surfaces of the stacked coins so as to get out of proper orientation during the wrapping operation and fly out from between the wrapping rollers.

The above and other objects and features of the present invention will become apparent from the following description made with reference to the accompanying drawings.

DESCRIPTION OF THE PREFERRED EMBODIMENT

Figure 1:
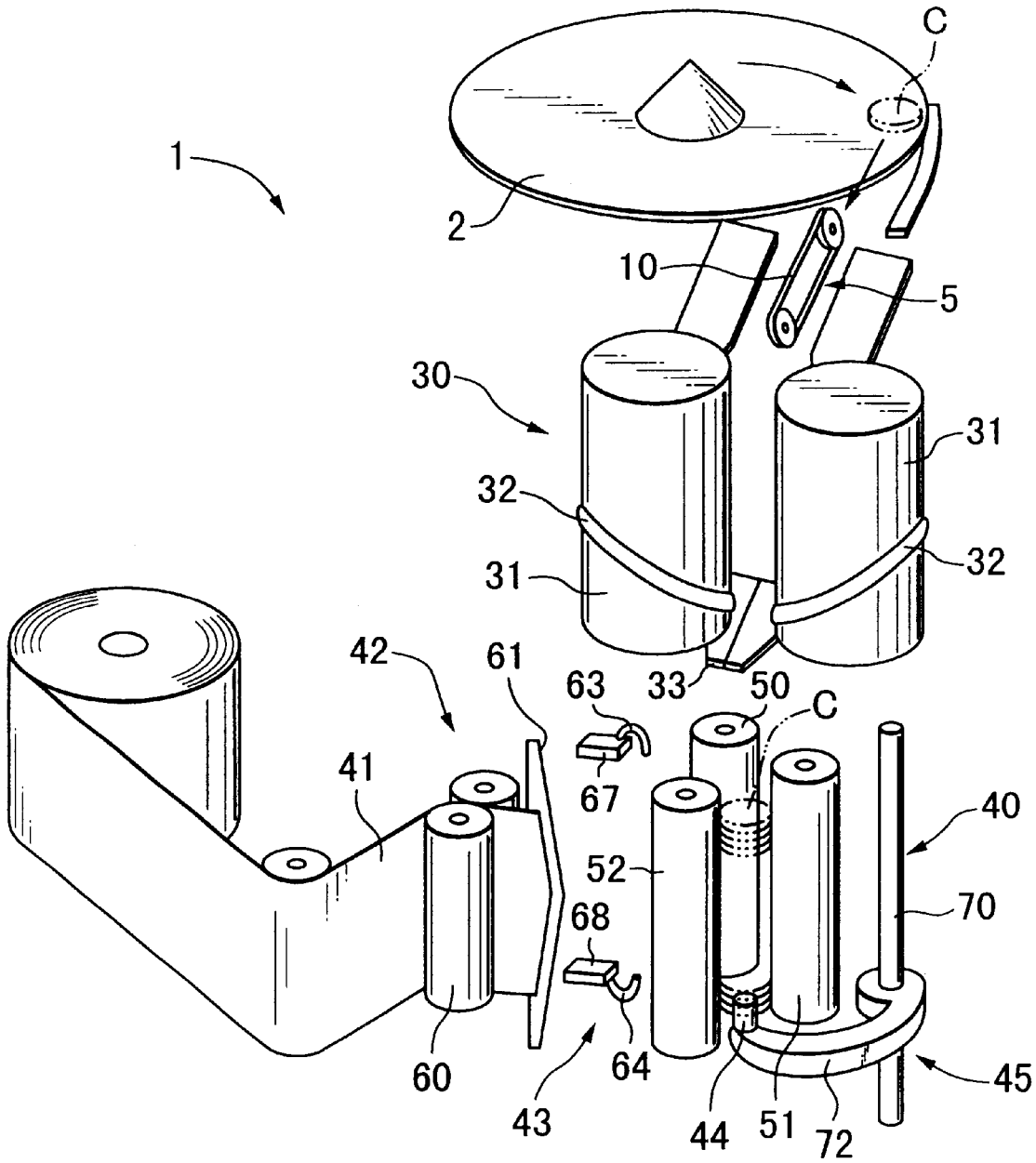
FIG. 1 is a schematic perspective view showing the mechanism of a coin wrapping machine which is a preferred embodiment of the present invention.
Figure 2:
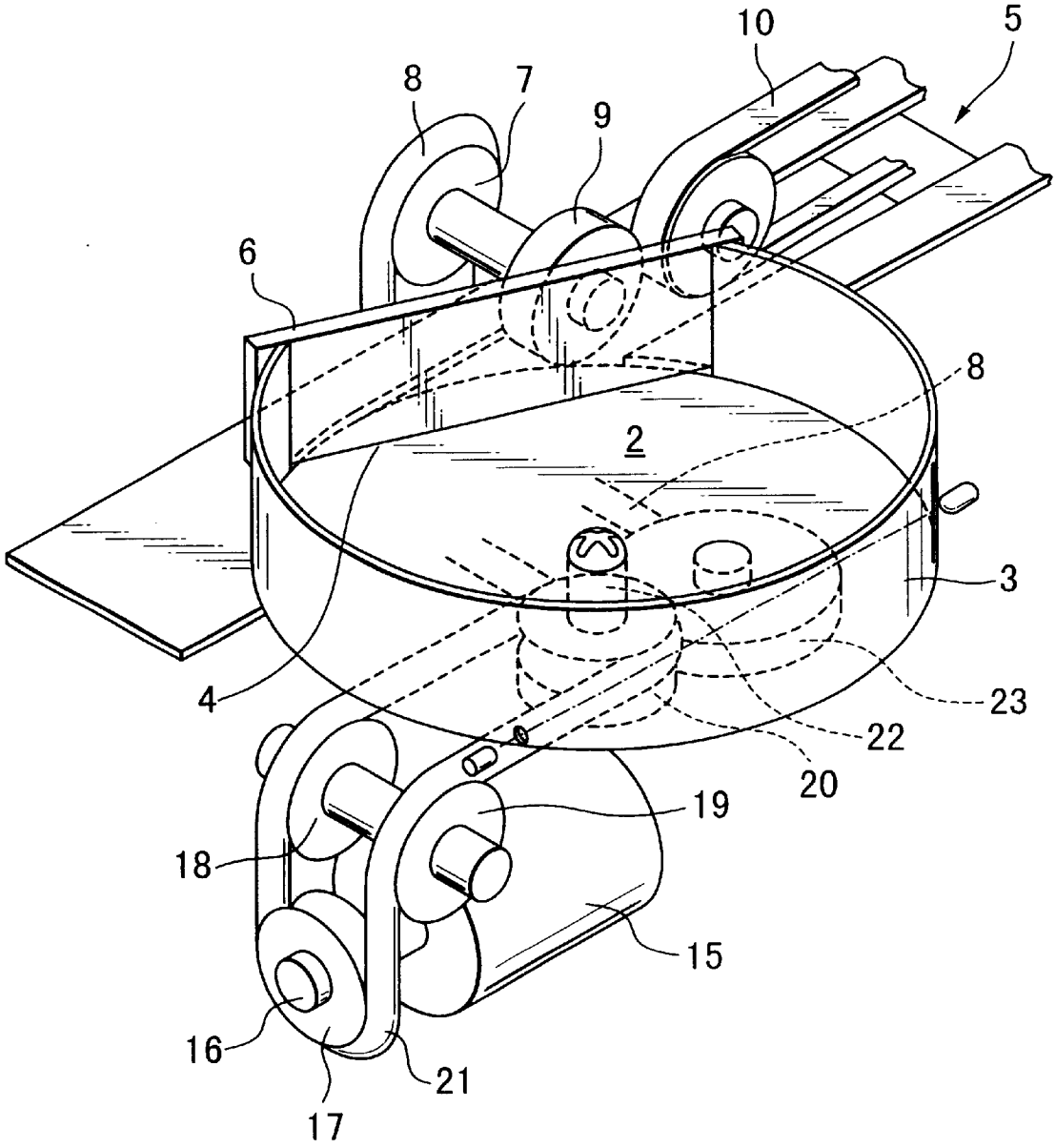
FIG. 2 is a schematic perspective view showing the vicinity of a rotatable disk.

As shown in FIGS. 1 and 2, a coin wrapping machine 1 is provided with a rotatable disk 2 and coins C deposited through a coin depositing opening (not shown) into the coin wrapping machine 1 are fed onto the rotatable disk 2. The outer circumference of the rotatable disk 2 is formed with an annular guide 3 so that the coins C fed onto the rotatable disk 2 are guided along the annular guide 3 by centrifugal force produced by the rotation of the rotatable disk 2 and are fed into a coin passage 5 through an opening 4 one by one. In FIG. 2, the reference numeral 6 designates a double feed preventing member and the opening 4 is formed between the lower edge portion of the double feed preventing member 6 and the upper surface of the rotatable disk 2. The vertical width of the opening 4 is set to be greater than the thickness of the thickest coins C to be wrapped and equal to or smaller than double the thickness of the thinnest coins C to be wrapped. The coins C fed into the coin passage 5 through the opening 4 are fed downstream in the coin passage 5 by a take-out roller 9 driven by an endless belt 8 wound around a pulley 7 and the coins C are further transported in the coin passage 5 in such a manner that they are held between a transporting belt 10 and the upper surface of the coin passage 5. In FIG. 1, the annular guide 3, the double feed preventing member 6, the pulley 7, the belt 8 and the take-out roller 9 are omitted.

The rotatable disk 2 is adapted to be rotated by a motor 15 mounted on a support member (not shown) fixed to a machine body (not shown). An endless belt 21 wound around a pulley 18, a pulley 19 and a pulley 20 is wound around a pulley 17 fixed to the output shaft 16 of the motor 15 and a rotation shaft of the rotatable disk 2 is fixed to the pulley 20. The driving force of the motor 15 is transmitted to the take-out roller 9 via the pulley 20, a pulley 23, the endless belt 8 and the pulley 7. Since the rotatable disk 2 and the take-out roller 9 are constituted so as to be driven by the common motor 15 in this manner, space saving and cost reduction can be realized. Further, since the output shaft 16 of the motor 15 is not directly connected to the rotatable disk 2 and the driving force of the motor 15 is transmitted to the rotatable disk 2 via the endless belt 21, much more space saving can be realized.

The motor 15 is a variable speed motor such as a pulse motor whose speed is variable by determining the number of pulse.

In the coin passage 5, there are provided a discriminating sensor (not shown) for discriminating whether or not coins C are acceptable and the denominations of coins C and a counting sensor (not shown) for counting the number of coins C. When the discriminating sensor detects unacceptable coins such as counterfeit coins, foreign coins and the like or coins having other denominations than that of coins to be wrapped, they are returned to the outside of the coin wrapping machine via a chute (not shown). When the counting sensor has detected a predetermined number of coins to be wrapped, a stopper (not shown) disposed in the vicinity of the downstream end portion of the coin passage 5 is driven, thereby preventing following coins from being fed into a coin stacking section 30 disposed downstream of the coin passage 5.

The coin stacking section 30 is provided with a pair of stacking drums 31, 31 for stacking coins C fed out from the coin passage 5 one by one therebetween and guiding them downwardly. The stacking drums 31, 31 are disposed in such a manner that their axes are parallel to each other and the distance between their outer circumferential surfaces is slightly smaller than the outer diameter of coins to be wrapped and the outer circumferential surfaces are formed with spiral protrusions 32, 32 extending in opposite directions to each other. The pair of stacking drums 31, 31 are intermittently rotated in opposite directions to each other in synchronism with the feed of coins C from the coin passage 5 while the vertical positions of the respective protrusions 32, 32 coincide.

The coins C fed from the coin passage 5 into the coin stacking section 30 are lowered in accordance with the rotation of the pair of stacking drums 31, 31 while their circumferential edge portions are being supported by the spiral protrusions 32, 32 of the the pair of stacking drums 31, 31. Following coins C are successively seated on the coin C supported by the protrusions 32, 32 and stacked.

Below the pair of stacking drums 31, 31, a shutter 33 is provided and the coins C stacked in the coin stacking section 30 are delivered onto the shutter 33.

Below the shutter 33, a coin wrapping section 40 is further provided. The coin wrapping section 40 comprises a wrapping mechanism 42 for feeding a wrapping paper 41 to circumferences of the stacked coins C and winding it around the stacked coins and a crimping mechanism 43 for crimping the upper and lower end portions of the wrapping paper 41 wound around the stacked coins C.

The coin wrapping section 40 is disposed below the shutter 33 to be movably in the vertical direction and comprises a coin support post 44 for receiving stacked coins C from the shutter 33 and supporting them and a support post moving mechanism 45 for moving the coin support post 44 between a waiting position immediately below the shutter 33 where it receives the stacked coins C from the shutter 33, a wrapping position where the stacked coins C are wrapped by the wrapping mechanism 42 and a retracted position below the wrapping position.

Figure 3:
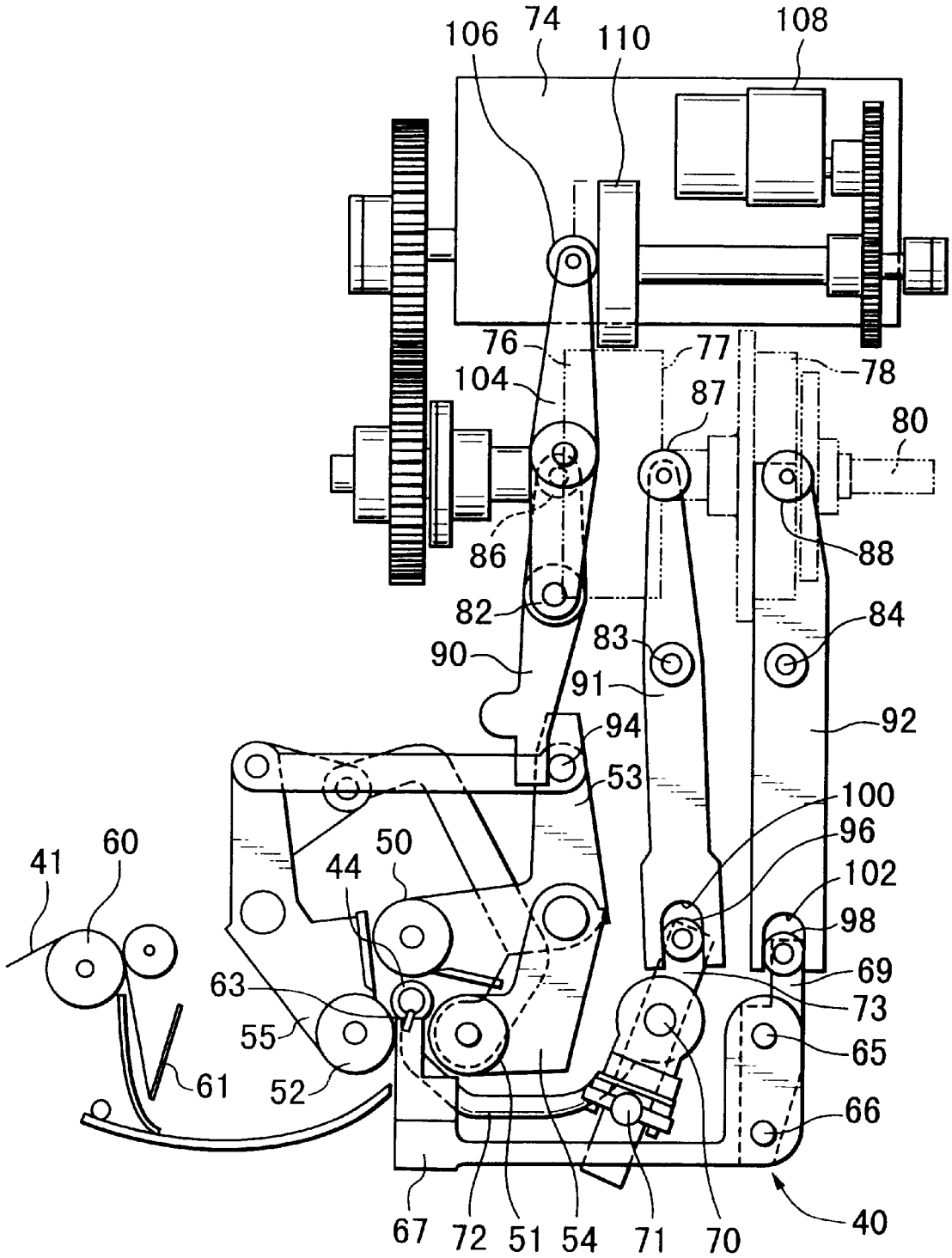
FIG. 3 is a schematic plan view showing the mechanism of a coin wrapping section.

FIG. 3 is a schematic plan view showing the mechanism of the coin wrapping section 40.

As shown in FIGS. 1 and 3, the wrapping mechanism 42 is provided with three wrapping rollers 50, 51, 52 adapted to hold the stacked coins C therebetween, which are fed from the coin stacking section 30 to the coin wrapping section 40 by the support post moving mechanism 45 while they are being supported on the coin support post 44. As shown in FIG. 3, the wrapping rollers 50, 51, 52 are provided so that their axes are parallel with each other and are rotatably mounted on wrapping roller supporting arms 53, 54, 55 respectively. As a result, the wrapping rollers 50, 51, 52 can be moved toward and apart from the circumferential surfaces of the stacked coins C supported on the coin support post 44 in accordance with the swinging operation of the wrapping roller supporting arms 53, 54, 55.

The wrapping mechanism 42 is further provided with a wrapping paper feed roller 60 for taking out the wrapping paper 41 by a paper feed motor (not shown) and a cutter 61 for cutting the fed wrapping paper 41 having a length for two windings.

As shown in FIGS. 1 and 3, the crimping mechanism 43 is provided with a pair of crimp claws 63, 64 spaced apart from each other in the vertical direction and is constituted so that the pair of crimp claws 63, 64 move toward each other so as to approach the stacked coins C from the upper and lower directions and crimp the upper edge portion and lower edge portions of the wrapping paper 41 under the condition that the wrapping paper 41 is wound around the stacked coins C and the stacked coins C are gripped between the wrapping rollers 50, 51 and 52. A pair of crimp claws 63, 64 are mounted on the tip end portions of crimp claw arms 67, 68 which are vertically movable along a center shaft 65 and a guide shaft 66 both of which are vertically disposed. The center shaft 65 and the guide shaft 66 are connected with a swing member 69 which is swingable about the center shaft 65 in the horizontal direction.

The support post moving mechanism 45 includes a support arm 72 having the coin support post 44 on its tip end portion and movable in the vertical direction along a center shaft 70 and a guide shaft 71 both of which are vertically disposed, and a swing member 73 with which the center shaft 70 and the guide shaft 71 are connected and which is swingable about the center shaft 70 in the horizontal direction.

The wrapping mechanism 42, the crimping mechanism 43 and the support post moving mechanism 45 are all connected with a single cam motor 74 and are therefore driven by a cam shaft 80 having cams 76, 77 and 78. More specifically, the wrapping mechanism 42, the crimping mechanism 43 and the support post moving mechanism 45 respectively include swing levers 90, 91 and 92 which are respectively swingable about vertical support shafts 82, 83 and 84. Rotatable cam followers 86, 87 and 88 are respectively mounted on one end portions of the swing levers 90, 91 and 92, and the other end portions of the swing levers 90, 91 and 92 are respectively connected with the end portions of the wrapping roller supporting arm 53 and the swing members 73 and 69. The other end portion of the swing lever 90 contacts a support shaft 94 of the wrapping roller supporting arm 53 so that the swing lever 90 and the wrapping roller supporting arm 53 are connected with each other. The swing levers 91 and 92 respectively have U-shaped notched portions 100 and 102 into which rollers 96 and 98 rotatably mounted on the tip end portions of the swing members 73 and 69 are respectively engaged.

The cam followers 86, 87 and 88 provided on one end portions of the swing levers 90, 91 and 92 are biased by a biasing device (not shown) so as to constantly contact with the cam surfaces of the respective cams 76, 77 and 78 on the cam shaft 80, and the swing levers 90, 91 and 92 swing by following the cam profiles formed on the cam surfaces of the cams 76, 77 and 78.

The support shaft 82 of the swing lever 90 of the wrapping mechanism 42 is rotatably mounted on one end portion of another swing lever 104 which has a cam follower 106 on its other end portion. The cam follower 106 is maintained in contact with a cam 110 connected with a denomination selecting motor 108 by a spring (not shown). The denomination selecting motor 108 is adapted to adjust the wrapping positions of the wrapping rollers 50, 51 and 52 based on the diameter of the coin C whose denomination is selected by the denomination selecting section (not shown).

Figure 4:
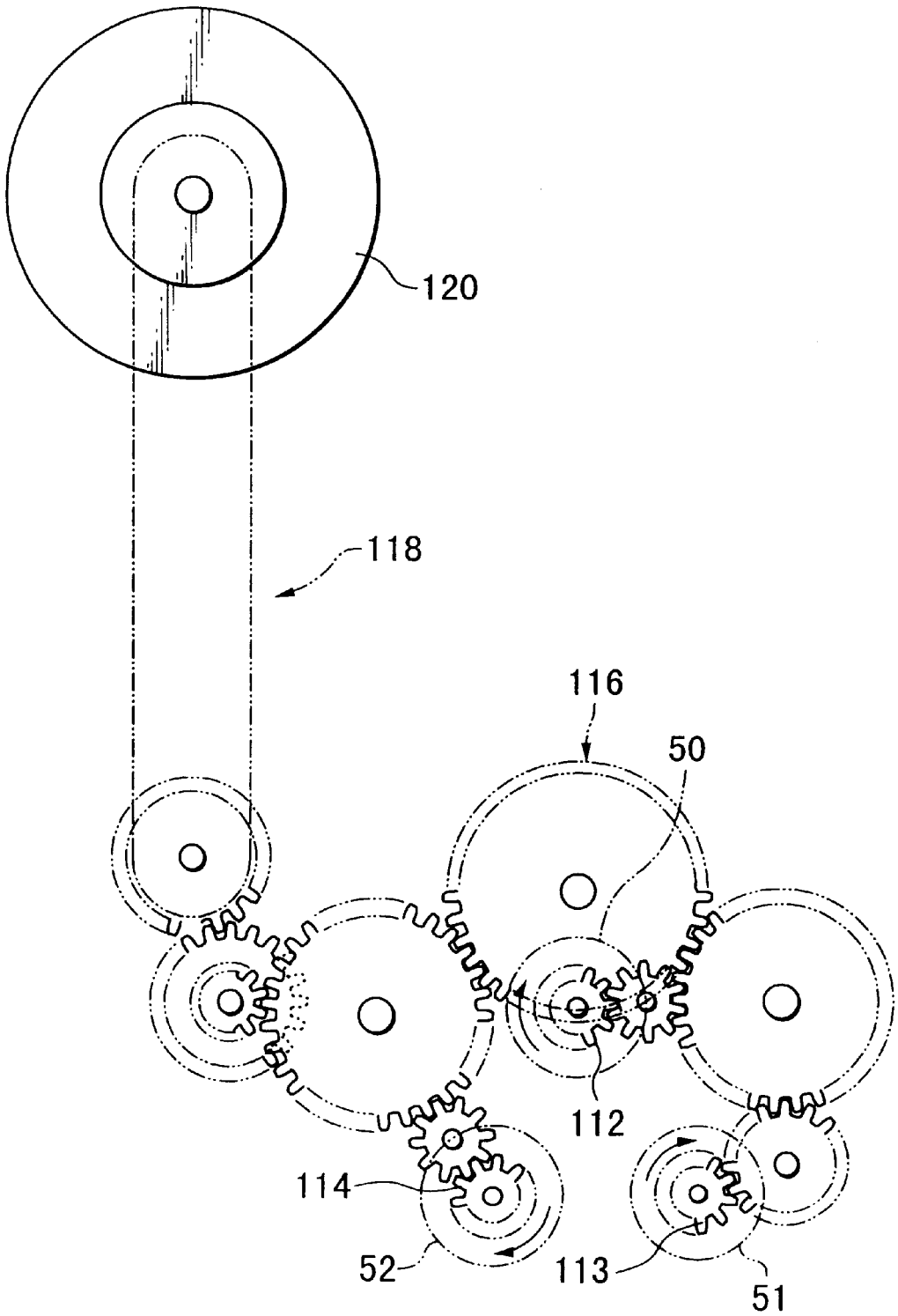
FIG. 4 is a schematic plan view of the driving mechanism of wrapping rollers.

FIG. 4 is a schematic plan view of the driving mechanism of wrapping rollers 50, 51, 52.

As shown in FIG. 4, the three wrapping rollers 50, 51 and 52 are respectively provided with gears 112, 113 and 114 which are connected with a wrapping motor 120 through a gear train 116 and a pulley belt 118. Thus, when the wrapping motor 120 operates, the wrapping rollers 50, 51 and 52 are driven synchronously to rotate in the same direction.

The cam motor 74 and the wrapping motor 120 are variable speed motors such as pulse motors whose speed varies with phase number.

The crimp claws 63, 64 and the coin support post 44 are respectively connected with the tip end portions of other swing levers (not shown) which are vertically swingable by following other cams (not shown) mounted on the camshaft 80. Thus, the crimp claws 63, 64 and the coin support post 44 are moved upward and downward by the up and down movements of the tip end portions of these vertically swingable levers.

Figure 5:
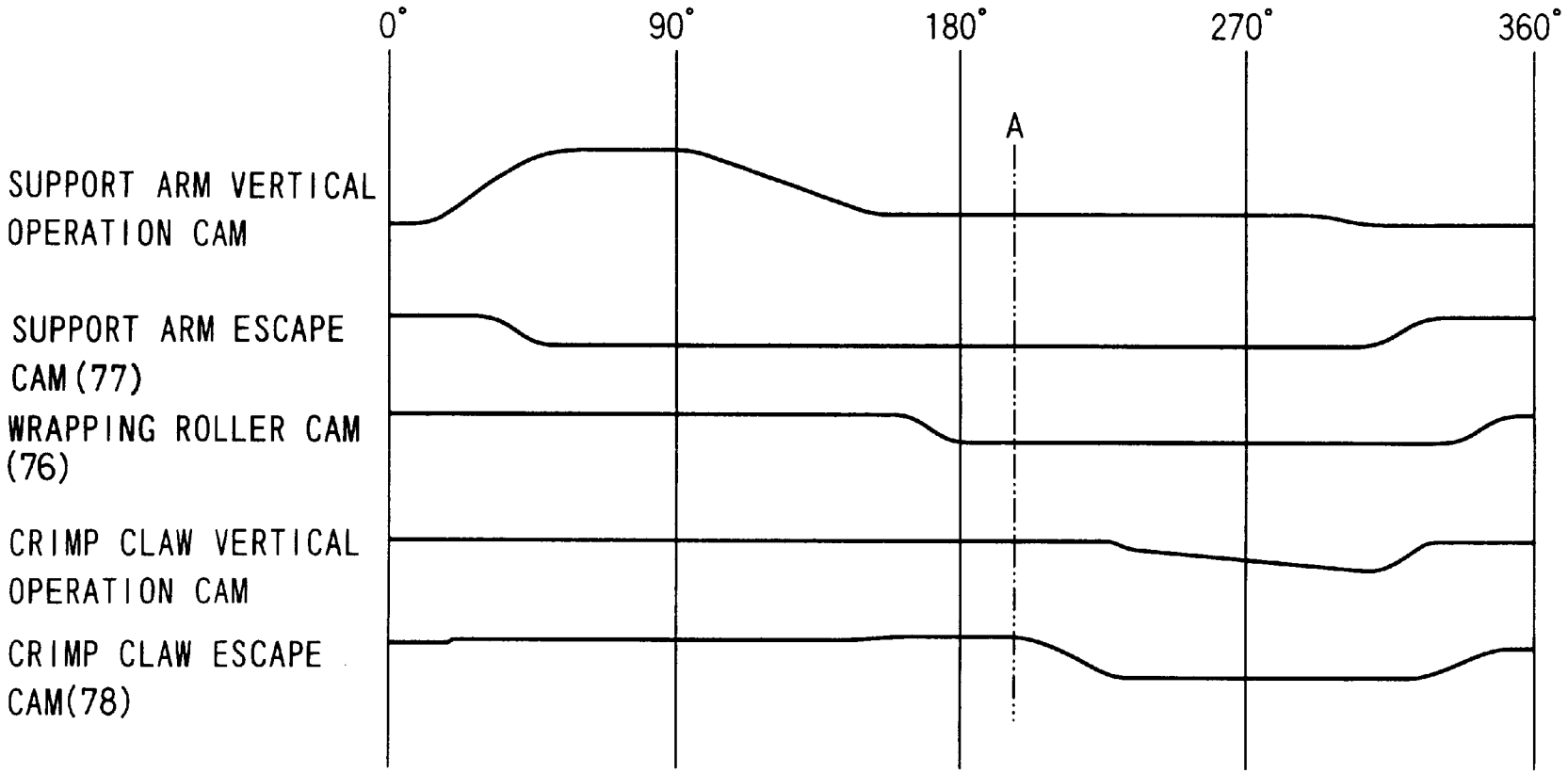
FIG. 5 is a cam chart for showing the movement of cams.

FIG. 5 is a cam chart for showing the cam operations of the cams 76, 77, 78 and the like.

From the top to the bottom in FIG. 5, the cam diagrams of the support arm vertical operation cam for controlling the vertical movement of the coin support post 44 which transports stacked coins C, the support arm escape cam 77 for controlling the horizontal movement of the coin support post 44, the wrapping roller cam 76 for controlling the operation of the wrapping rollers 50, 51 and 52 to grip the stacked coins C and move away from the stacked coins C, the crimp claw vertical operation cam for controlling the vertical movement of the crimp claw arms 67, 68 provided with the crimp claws 63, 64 and the crimp claw escape cam 78 for controlling the horizontal movement of the crimp claw arms 67, 68 are respectively illustrated.

Regarding the cam diagram of the crimp claw vertical operation cam, only the cam diagram of the cam for the upper crimp claw 63 is shown and that for the lower crimp claw 64 is not shown, since the cam diagrams for the upper and lower crimp claw 63, 64 are symmetrical in the vertical direction.

In this cam chart, the initial position of the camshaft 80, namely, 0 degree is shown on the far left, and as the camshaft 80 rotates, the cam diagrams progress to the right, finally reaching the far right, namely, 360 degrees where the camshaft 80 has made one rotation.

The support arm vertical operation cam makes the coin support post 44 move upward in the region between 10 degrees and 45 degrees, wait at the waiting position immediately below the shutter 33 in the region between 45 degrees and 90 degrees, move downward in the region between 90 degrees and 140 degrees, and move further downward to the wrapping position and the retracted position in the region between 140 degrees and 360 degrees.

The support arm escape cam 77 makes the coin support post 44 move to the waiting position below the shutter 33 by rotating the guide shaft 71 clockwise about the center shaft 70 in the region between 30 degrees and 45 degrees, keep its horizontal position below the shutter 33 in the region between 45 degrees and 305 degrees, and move to the retracted position apart from the wrapping rollers 50, 51 and 52 by rotating the guide shaft 71 counterclockwise about the center shaft 70 in the region 305 degrees and 330 degrees.

The wrapping roller cam 76 makes the wrapping rollers 50, 51 and 52 wait at their respective waiting positions where the wrapping rollers 50, 51 and 52 are most apart from each other in the region between 0 degree and 160 degrees, move toward each other in the region between 160 degrees and 180 degrees, grip and hold the stacked coins C in the region between 180 degrees and 330 degrees, and move away from each other to separate from the stacked coins in the region between 330 degrees and 360 degrees.

The crimp claw vertical operation cam makes the crimp claws 63 move toward each other in the region between 230 degrees and 320 degrees, move away from each other in the region between 320 degrees and 335 degrees, and wait at the retracted positions where the crimp claws 63 are most apart from each other in the regions between 0–230 degrees and 335–360 degrees.

The crimp claw escape cam 78 makes the crimp claws 63 wait at the escape position where the crimp claws 63 are horizontally apart from the wrapping rollers 50, 51 and 52 in the region between 0 degree and 180 degrees, move to positions above and below the space enclosed by the wrapping rollers 50, 51 and 52 by the horizontally moving the crimp claw arms 67 in the region between 180 degrees and 210 degrees, wait at these positions in the region between 210 degrees and 330 degrees, and retract horizontally from the wrapping rollers 50, 51 and 52 in the region between 330 degrees and 360 degrees.

Figure 6:
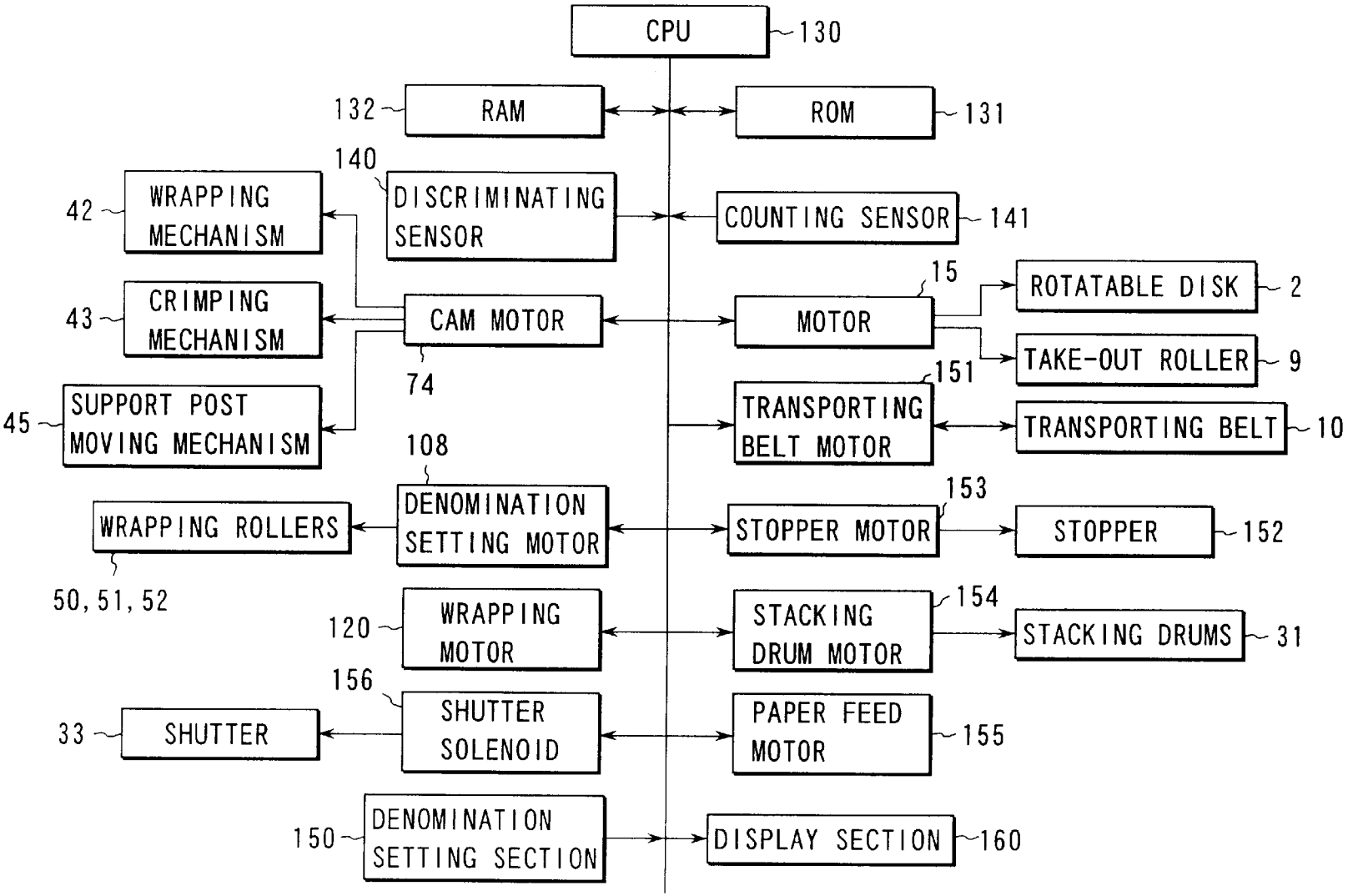
FIG. 6 is a block diagram of a control system, a detection system, a driving system, an input system and a display system of a coin wrapping machine 1 which is a preferred embodiment of the present invention.

FIG. 6 is a block diagram of a control system, a detection system, a driving system, an input system and a display system of a coin wrapping machine 1 which is a preferred embodiment of the present invention.

As shown in FIG. 6, the control system of the coin wrapping machine 1 includes a CPU 130 for controlling the entire operation of the coin wrapping machine 1, a ROM 131 for storing reference data such as diameters, thickness and shapes of respective denominations of coins C, position data of the wrapping rollers 50, 51, 52 for each denomination of coins C, driving speed data of the wrapping rollers 50, 51, 52 for each denomination of coins C, driving speed data of the rotatable disk 2 and the take-out roller 9 for each denomination of coins C, driving speed data of transporting belt 10 for each denomination of coins C, driving speed data of the crimp claws 63 and 64 for each denomination of coins C and an operation program for the whole coin wrapping machine 1, and a RAM 132 for storing various data such as denomination data of coins C, counting data of coins C and stacked coin number data.

As shown in FIG. 6, the detection system of the coin wrapping machine 1 includes a discriminating sensor 140 provided in the coin passage 5 for discriminating whether or not coins are acceptable and the denomination of coins, and a counting sensor 141 provided in the coin passage 5 for counting the number of coins.

As shown in FIG. 6, the driving system of the coin wrapping machine 1 includes the motor 15 for rotating the take-out roller 9 as well as the rotatable disk 2, the cam motor 74 for driving the wrapping mechanism 42, the crimping mechanism 43 and the support post moving mechanism 45, a denomination setting motor 108 for adjusting the positions of the wrapping rollers 50, 51, 52, when an operator sets the denomination of coins C using a denomination setting section such as a keyboard, based on the diameter of the coin C whose denomination was thus selected, a wrapping motor 120, a transporting belt motor 151 for driving the transporting belt 10, a stopper motor 153 for driving the stopper 152 disposed in the vicinity of the downstream end portion of the coin passage 5, a stacking drum motor 154 for intermittently rotating the pair of stacking drums 31, 31, a paper feed motor 155 for taking out the wrapping paper 41 and a shutter solenoid 156 for opening and closing the shutter 33.

Further, as shown in FIG. 6, the input system of the coin wrapping machine 1 includes a denomination setting means 150 constituted by a keyboard or the like.

Moreover, as shown in FIG. 6, the display system of the coin wrapping machine 1 includes a display section 160 constituted by a CRT or the like.

The thus constituted coin wrapping machine 1 according to the preferred embodiment of the present invention wraps coins C and produces a wrapped coin roll including a predetermined number of wrapped coins C as follows.

When the operator inputs the denomination of coins C to be wrapped through the denomination setting section 150 such as a keyboard, the input denomination is stored in the RAM 132.

The CPU 130 reads out the denomination of coins C to be wrapped stored in the RAM 132 and displays the thus read out denomination on the display section 160. Simultaneously, the CPU 130 reads out from the ROM 131 the data relating to the denomination of coins C, namely, data regarding positions of the wrapping rollers 50, 51, 52 for wrapping the input denomination of coins C and the data regarding the driving speed of the rotatable disk 2, the driving speed of the take-out roller 9, the driving speed of the transporting belt 10 and the driving speed of the crimp claws 63, 64.

At the same time, the CPU 130 calculates a handling speed and/or time required for the handling of coins C based on the thus read out data regarding driving speeds and displays the speed/time on the display section 160 in order to inform the operator how much longer or shorter the operation time becomes as compared with the handling of the reference coin C.

The CPU 130 outputs a drive signal to the denomination setting motor 108 based on the data regarding positions of the wrapping rollers 50, 51, 52 for wrapping the set denomination of coins C and moves the wrapping rollers 50, 51, 52 to the respective positions so as to coincide with the outer diameter of the set denomination of coins C.

When coins C are deposited into the coin wrapping machine 1 through a coin depositing opening (not shown), the coins C are fed onto the rotatable disk 2.

The coins C fed onto the rotatable disk 2 are guided along the annular guide 3 provided at the outer circumferential portion of the rotatable disk 2 by centrifugal force produced by the rotation of the rotatable disk 2 and fed out one by one into the coin passage 5 through the opening 4. At this time, since the vertical width of the opening 4 formed between the lower edge portion of the double feed preventing member 6 and the upper surface of the rotatable disk 2 is set to be greater than the thickness of the thickest coins C to be wrapped and equal to or smaller than double the thickness of the thinnest coins C to be wrapped, two or more coins can be prevented from being simultaneously fed into the coin passage 5.

The coins C fed into the coin passage 5 from the opening 4 are fed downstream in the coin passage 5 by the take-out roller 9 driven the endless belt 8 wound around the pulley 7 and further transported in the coin passage 5 while being held between the transporting belt 10 and the upper surface of the coin passage 5. Since the rotatable disk 2 is rotated by the motor 15 and the driving force of the motor 15 is transmitted to the take-out roller 9 via the pulley 20, the pulley 23, the endless belt 8 and the pulley 7, the rotation speed of the rotatable disk 2 and the rotation speed of the take0out roller are synchronous with each other. Although the transporting belt 10 is driven by a transporting belt motor 151 separate from the motor 15, the driving speed of the transporting belt motor 151 is synchronous with the driving speed of the motor 15. In this embodiment, the CPU 130 is constituted so as to produce drive signals based on the driving speed data of the rotatable disk 2 and the take-out roller 9 and the driving speed data of the transporting belt 10 read out from the ROM for the denomination of coins C to be wrapped and output the drive signals to the motor 15 and the transporting belt motor 151. More specifically, in the case where a circular coin C having a predetermined diameter and a predetermined thickness is determined as a reference coin and the diameter of coins C to be wrapped is smaller than that of the reference coin, if the rotation speed of the rotatable disk 2 is equal to the reference rotation speed of the rotatable disk 2 for wrapping the reference coins, a greater number of coins C are fed out into the coin passage 5 per unit time than that of reference coins. It therefore sometimes happens that coins C jam in the coin stacking section 30 and cannot be stacked therein in the desired manner. Therefore, the driving speed data of the rotatable disk 2 and the take-out roller 9 and the driving speed data of the transporting belt 10 are set to be lower than the respective reference driving speeds of the reference coins. On the other hand, in the case where the diameter of coins C to be wrapped is greater than that of the reference coin, since the coin weight is great, if the coins C are transported in the coin passage 5 by the transporting belt 10 at the same speed as the reference speed when the reference coins are transported, the coins C are not stacked in the desired manner at a portion between the pair of stacking drums 31, 31 in the coin stacking section 30 due to their inertia force. Therefore, the driving speed data of the rotatable disk 2 and the take-out roller 9 and the driving speed data of the transporting belt 10 are set to be lower than the respective reference driving speeds of the reference coins. Further, in the case where coins C to be wrapped are thicker than the reference coin, since the amount of rotation of the pair of stacking drums 31, 31 required for stacking one coin C becomes great, if the driving speed of the transporting belt 10 is the same as the reference driving speed for transporting the reference coins, the coins C sometimes jam between the pair of stacking drums 31, 31. Therefore, the driving speed data of the rotatable disk 2 and the take-out roller 9 and the driving speed data of the transporting belt 10 are set to be lower than the respective reference driving speeds of the reference coins. To the contrary, in the case where coins C to be wrapped are thinner than the reference coin, the amount of rotation of the pair of stacking drums 31, 31 required for stacking one coin C becomes small and the driving speed of the transporting belt 10 can be higher for improving the handling efficiency of coins C. Therefore, the driving speed data of the rotatable disk 2 and the take-out roller 9 and the driving speed data of the transporting belt 10 are set to be higher than the respective reference driving speeds of the reference coins. Furthermore, in the case where coins C to be wrapped are polygonal, as described later, since the rotation speed of the wrapping rollers 50, 51, 52 is controlled to be lower than that for wrapping the reference coins, the driving speeds of the rotatable disk 2 and the take-out roller 9 for feeding coins C into the coin passage 5 and the transporting belt 10 have to be set lower. Therefore, the driving speed data of the rotatable disk 2 and the take-out roller 9 and the driving speed data of the transporting belt 10 are set to be lower than the respective reference driving speeds of the reference coins.

The coins C transported in the coin passage 5 by the transporting belt 10 are discriminated by the discriminating sensor 140 as to whether or not the coins C are acceptable and as to the denomination of the coins C. When the discriminating sensor 140 detects an unacceptable coin such as a counterfeit coin, a foreign coin or the like or a coin of denomination another than that to be wrapped, the coin is returned via a chute (not shown) to the outside of the coin wrapping machine 1. The coins C discriminated to be acceptable are further fed downstream in the coin passage 5 and the number thereof is counted by the counting sensor 141. The detection signals are input from the counting sensor 141 to the RAM 132 and the CPU 132 displays the count of the coins C on the display section 160 based on the detection signals input to the RAM 132.

When the CPU 130 judges that the number of the coins counted by the counting sensor 141 becomes equal to the number of coins to be contained in one wrapped coin roll and read out from the ROM 131, it outputs a drive signal to the stopper motor 153, thereby driving the stopper 152 provided in the vicinity of the downstream end portion of the coin passage 5 downstream of the counting sensor 141 so that it projects into the coin passage 5, thereby preventing following coins successively fed in the coin passage 5 from being fed into the coin stacking section 30 and feeding only coins C whose number is equal to that to be contained in one wrapped coin roll into the coin stacking section 30. At the same time, the CPU 130 outputs a drive signal to the cam motor 74 so as to actuate the support post moving mechanism and move the coin support post 44 to the waiting position immediately below the shutter 33.

As described above, since the CPU 130 sets the driving speeds of the rotatable disk 2, the take-out roller 9 and the transporting belt 10 in accordance with the denomination of coins to be wrapped, in the case where the diameter of coins C is smaller than that of the reference coin, it is possible to efficiently prevent a great number of the coins from being fed into the coin stacking section 30 and the coins C from jamming in the coin stacking section 30. On the other hand, in the case where the diameter of coins C is greater than that of the reference coin, it is possible to efficiently prevent the coins C from failing to be stacked between the pair of stacking drums 31, 31 in the coin stacking section 30 due to their inertia force.

The coins C fed from the coin passage 5 into the coin stacking section 30 are lowered as the pair of stacking drums 31, 31 are intermittently rotated in the opposite directions to each other in synchronism with the feed of the coin C from the coin passage 5, while the peripheral edge portions of the coins C are being supported by the spiral protrusions 32, 32 formed on the outer circumferential surfaces of the pair of stacking drums 31, 31 so as to extend in the opposite directions to each other. The following coins C are successively piled on the coin C supported on the protrusions 32, 32 and stacked. In the case where the coins C to be wrapped are thicker than the reference coin, the amount of rotation of the pair of stacking drums 31, 31 required for stacking one coin C becomes great and time required for stacking them becomes longer. However, in this embodiment, in the case where the coins C to be wrapped are thicker than the reference coin, the CPU 130 controls the motor 15 so that the rotation speed of the rotatable disk 2 and the rotation speed of the takeout roller 9 become lower and also controls the transporting belt motor 151 so that the driving speed of the transporting belt 10 becomes lower. Therefore, it is possible to efficiently prevent the coins C from jamming between the pair of stacking drums 31, 31. On the other hand, in the case where coins C to be wrapped are thinner than the reference coin, the CPU 130 controls the motor 15 so that the rotation speed of the rotatable disk 2 and the rotation speed of the take-out roller 9 become higher and also controls the transporting belt motor 151 so that the driving speed of the transporting belt 10 becomes higher. Therefore, it is possible to improve the handling speed of the coins C.

The coins C stacked in the coin stacking section 30 are placed on the upper surface of the shutter 33 provided below the pair of stacking drums 31, 31.

When the coins C have been placed on the shutter 33 in the proper number, the CPU 130 outputs a drive signal to the shutter solenoid 156 so as to open the shutter 33, thereby delivering the stacked coins C onto the upper surface of the coin support post 44 positioned at the waiting position immediately below the shutter 33.

When the coin support post 44 has supported the stacked coins C on the upper surface thereof, the coin support post 44 is lowered to the wrapping position by the post support mechanism 45, whereby the stacked coins C are transferred to a location between the three wrapping rollers 50, 51, 52 in the coin wrapping section 40.

When the coin support post 44 has reached the wrapping position, the CPU 130 drives the cam motor 74 so as to rotate the cam shaft 80, thereby swinging the swing lever 90 and the roller support arms 53, 54 and 55. As a result, the three wrapping rollers 50, 51, 52 are moved toward the circumferential surfaces of the stacked coins C. At the same time, the CPU 130 outputs drive signals to the paper feed motor 155 and the wrapping motor 120 so as to rotate the wrapping paper feeding roller 60 and the wrapping rollers 50, 51, 52. As a consequence, the stacked coins C are held between the wrapping rollers 50, 51, 52 while the wrapping paper 41 is being inserted between the stacked coins C and the three wrapping rollers 50, 51, 52. When the stacked coins C have been held between the wrapping rollers 50, 51, 52, the coin support post 44 is moved to the retracted position below the wrapping position.

The wrapping paper 41 is wound around the circumference of the stacked coins C in accordance with the rotation of the wrapping rollers 50, 51, 52.

The crimping mechanism 43 is then driven and the crimp claws 63, 64 spaced apart in the vertical direction are moved toward each other so as to approach the stacked coins C from the upper and lower directions and crimp the upper edge portion and lower edge portions of the wrapping paper 41 under the condition that the wrapping paper 41 is wound around the stacked coins C and the stacked coins C are held between the wrapping rollers 50, 51 and 52, thereby producing a wrapped coin roll.

When the wrapped coin roll has been produced, the wrapping rollers 50, 51, 52 gripping the stacked coins C therebetween are moved apart from each other and the wrapped coin roll is discharged to the outside of the coin wrapping machine 1 via a chute (not shown) provided below the coin wrapping section 40.

In this embodiment, in the case where the shape of coins C to be wrapped is not circular, for example, the shape thereof is polygonal, the CPU 130 controls the speeds of the cam motor 74 and the wrapping motor based on the driving speed data corresponding to the shape of the coins C stored in the ROM 131.

Concretely, the CPU 130 starts controlling at the point A in the cam chart shown in FIG. 5 and completes the control in the region between 330 degrees and 360 degrees in the cam chart where the rollers 50, 51 and 52 are apart from each other. The point A in FIG. 5 is the time when the wrapping motor 120 and the cam motor 74 start the wrapping operation.

In the where coins C to be wrapped are circular, the cam motor 74 is operated at its maximum speed and without decreasing its speed at the point A and the wrapping motor 120 is also operated at its maximum speed.

On the other hand, when the coins C to be wrapped are polygonal, the wrapping motor 120 and the cam motor 74 are operated at speeds decreased to about 55 percent of their respective operating speeds when the coin C are circular.

Therefore, in the case where coins C to be wrapped are circular, when the wrapping paper 41 is fed into between the wrapping rollers 50, 51, 52 and the stacked coins C, the wrapping rollers 50, 51, 52 are first operated at a relatively low driving speed N1, thereby winding the wrapping paper 41 around the circumferential surfaces of the stacked coins C to some extent. Thereafter, at the point A shown in FIG. 5, the CPU 130 changes the operating speed of the wrapping rollers 50, 51, 52 to a speed N2 which is double the speed N1 so that the wrapping paper 41 is wound around the stacked coins C at high speed.

On the other hand, in the case where coins C to be wrapped are polygonal, the CPU 130 controls the driving speed of the wrapping motor 120 in the region after the point A to be lower than the speed N2 in case of circular coins, for example, about 55 percent of the speed N2. As a result, since the wrapping rollers 50, 51 and 52 are operated at the speed N1 in the region before the point A and are operated at about 55 percent of the speed N2 from and in the region after the point A while the stacked coins C are gripped between the wrapping rollers 50, 51 and 52, strong vibration caused by the ups and downs on the circumferential surfaces of the stacked polygonal coins C can be prevented, and, therefore, the coins can be effectively prevented from flying out from between the wrapping rollers 50, 51 and 52.

Further, in the coin wrapping machine 1 in accordance with this embodiment, in the case where coin C to be wrapped is polygonal, the operating speed of the cam motor 74 is also decreased to about 55 percent of the speed in case of a circular coin from and in the region after the point A where the operating speeds of the wrapping rollers 50, 51 and 52 are decreased to about 55 percent of the speed N2. More specifically, at the point A and in the region after the point A, the crimp claws 63, 64 come toward each other to approach the opposite end surfaces of the stacked coins C in order to crimp the opposite ends of the wrapping paper 41 by the operation of the cam motor 74. As explained above, in case of a polygonal coin, since the operating speeds of the wrapping rollers 50, 51 and 52 are decreased to about 55 percent of the speed N2, the moving speeds of the crimp claws 63, 64 are decreased proportionally to that of the wrapping rollers 50, 51, 52 so that the crimping time of the crimp claws 63, 64 becomes longer.

In this manner, since the moving speed of the crimp claws 63, 64 is controlled proportionally to the rotation speeds of the wrapping rollers 50, 51, 52, even when the rotation speeds of the wrapping rollers 50, 51, and 52 are reduced, enough time for the crimp claws 63, 64 to crimp the opposite ends of the wrapping paper 41 can be obtained and a good crimp operation by the crimp claws 63, 64 can be carried out.

Further, in this embodiment, in the case where coins C to be wrapped are polygonal, the CPU 130 controls the driving speeds of the rotatable disk 2, the take-out roller 9 and the transporting belt 10 for feeding out the coins C into the coin wrapping section 40 to be lower. Therefore, even if the rotation speeds of the wrapping rollers 50, 51, 52 are controlled to be lower than that for wrapping reference coins, it is possible to efficiently prevent the coins C from jamming between the pair of stacking drums 31, 31.

When the wrapped coin roll has been discharged through a chute to the outside of the coin wrapping machine 1, the CPU 130 returns the operation speed of the cam motor 74 to normal speed.

According to the above described embodiment, a circular coin C having a predetermined diameter and a predetermined thickness is determined as a reference coin and in the case where the diameters of coins C to be wrapped are smaller than that of the reference coin, the CPU 130 controls the driving speeds of the rotatable disk 2 and the take-out roller 9 to be lower. Therefore, it is possible to reliably prevent a greater number of the coins C from being fed out into the coin passage 5 per unit time than in case of the reference coins and by this to prevent coins C from jamming in the coin stacking section 30 and prevent coins C from failing to be stacked in the coin stacking section 30 in the desired manner. Further, in the case where the diameter of coins C to be wrapped are larger than that of the reference coin, the CPU 130 controls the driving speeds of the rotatable disk 2 and the take-out roller 9 and the driving speed of the transporting belt 10 to be lower. Therefore, even though the coin weight is great, it is possible to efficiently prevent the coins C from failing to be stacked between the pair of stacking drums 31, 31 in the coin stacking section 30 in the desired manner due to their inertia force. Moreover, in the case where coins C to be wrapped are thicker than the reference coin, the CPU 130 controls the driving speeds of the rotatable disk 2 and the take-out roller 9 and the driving speed of the transporting belt 10 to be lower. Therefore, even though the amount of rotation of the pair of stacking drums 31, 31 required for stacking one coin C becomes great, it is possible to reliably prevent the coins C from jamming between the pair of stacking drums 31, 31. On the other hand, in the case where coins C to be wrapped are thinner than the reference coin, since the amount of rotation of the pair of stacking drums 31, 31 required for stacking one coin C is small, the CPU 130 controls the driving speeds of the rotatable disk 2 and the take-out roller 9 and the driving speed of the transporting belt 10 to be higher. Therefore, the handling efficiency of coins C can be improved. Further, in the case where coins C to be wrapped are polygonal, the CPU 130 controls the rotation speeds of the wrapping rollers 50, 51, 52 to be lower and also controls the driving speeds of the rotatable disk 2, the take-out roller 9 and the transporting belt 10 to be lower. Therefore, it is possible to efficiently prevent the coins C from jamming between the pair of stacking drums 31, 31. Furthermore, according to the above described embodiment, in the case where polygonal coins C are wrapped, not only the rotation speeds of the wrapping rollers 50, 51, 52 are controlled to be lower but the moving speeds of the crimp claws 63, 64 are also controlled to be lower in proportion to the control of the rotation speeds of the wrapping rollers 50, 51, 52. Therefore, strong vibration caused by the ups and downs on the circumferential surfaces of the stacked polygonal coins C can be prevented, and, therefore, the coins can be effectively prevented from getting out of proper orientation and flying out from between the wrapping rollers 50, 51 and 52. In addition, it is possible to crimp the opposite end portions of the wrapping paper 41 in a desired manner so as to produce a wrapped coin roll.

The present invention has thus been shown and described with reference to specific embodiments. However, it should be noted that the present invention is in no way limited to the details of the described arrangements but changes and modifications may be made without departing from the scope of the appended claims.

For example, in the above described embodiment, although the take-out roller 9 is provided between the rotatable disk 2 and the transporting belt 10, it is possible to extend the transporting belt 10 to the vicinity of the opening 4 and omit the take-out roller 9.

Further, in the above described embodiment, although the rotatable disk 2 and the take-out roller 9 are driven by the common motor 15, they may be driven by separate motors.

Furthermore, in the above described embodiment, although the output shaft 16 of the motor 15 is not directly connected to the rotatable disk 2 but the driving force of the motor 15 is transmitted to the rotatable disk 2 via the endless belt 21, when the rotatable disk 2 and the take-out roller 9 are driven by separate motors, the output shaft 16 of the motor 15 may be directly connected to the rotatable disk 2.

Moreover, in the above described embodiment, although the transporting belt 10 for transporting coins C is driven by the transporting belt motor 151 driven in synchronism with the motor 15 for driving the rotatable disk 2 and the take-out roller 9, the transporting belt 10 may be driven by the motor 15 by providing a driving force transmitting mechanism.

Further, in the above described embodiment, when the wrapping paper 41 is wound around polygonal stacked coins C, the driving speeds of the wrapping motor 120 and the cam motor 74 are reduced to about 55 percent of their respective driving speeds when the coin C is circular. However, it is not absolutely necessary to reduce the driving speeds of the wrapping motor 120 and the cam motor 74 to about 55 percent of their respective driving speeds when the coin C is circular and other speed values may be employed. Instead, the coin shapes can be subdivided into additional categories and the driving speeds of the wrapping motor 120 and the cam motor 74 be individually set to respective values based on the shape category of the coins to be wrapped. Further, these driving speed data may be input from the outside of the coin wrapping machine 1.

Furthermore, in the above described embodiment, although the rotating speeds of the wrapping rollers 50, 51, 52 are set to be constant, irrespective of the diameters of coins C to be wrapped, the wrapping rollers 50, 51, 52 may be rotated at different speeds depending upon the diameters of coins C to be wrapped. For example, the rotation speed of the wrapping rollers 50, 51, 52 may be set lower in proportion as the diameter of coins C to be wrapped becomes smaller and be set higher in proportion as the diameter of coins C to be wrapped becomes larger. In these cases, at the same time, the moving speeds of the crimp claws 63, 64 have to be set lower when the diameters of coins C are smaller or higher when the diameters of coins C are larger correspondingly to the control of the rotation speeds of the wrapping rollers 50, 51, 52. The stacked coins C can be more uniformly crimped irrespective of the diameters of coins C by controlling the rotation speeds of the wrapping rollers 50, 51, 52 and the moving speeds of the crimp claws 63, 64 in these manners.

Moreover, in the above described embodiment, the driving speed of the rotatable disk 2, the driving speed of the take-out roller 9, the driving speed of the transporting belt 10 and the rotation speeds of the wrapping rollers 50, 51, 52 are set to be constant irrespective of the quality of the wrapping paper 41. However, a sensor may be provided for detecting the quality of the wrapping paper 41 or the operator may input the quality of the wrapping paper 41 and the driving speeds of the rotatable disk 2, the take-out roller 9, the transporting belt 10, the wrapping rollers 50, 51, 52 and the crimp claws 63, 64 may be controlled by selecting, depending upon the quality of the wrapping paper 41, the driving speed data of the rotatable disk 2, the take-out roller 9, the transporting belt 10, the wrapping rollers 50, 51, 52 and the crimp claws 63, 64 produced in accordance with the quality of the wrapping paper 41 and stored in advance in the ROM 131.

Further, in the above described embodiment, although the stacked coins C are wrapped using the wrapping paper 41, the stacked coins C may instead be wrapped using other wrapping materials such as plastic film.

According to the present invention, it is possible to provide a coin wrapping machine which can stack and wrap coins having different shapes, diameters, thickness and the like efficiently and as desired.

What is claimed is:

1. A coin wrapping machine comprising denomination setting means for setting a denomination of coins to be wrapped, a rotatable disk for feeding coins toward a coin passage by centrifugal force produced by the rotation thereof, rotatable disk driving means for rotating the rotatable disk, transporting belt means for transporting the coins fed into the coin passage by the rotatable disk along the coin passage, transporting belt driving means for driving the transporting belt means, counting means disposed in the coin passage for counting the number of coins having the denomination set by the denomination setting means, and coin stacking means for stacking a predetermined number of coins whose number has been counted, said coin wrapping machine further comprising coin wrapping means comprising a plurality of wrapping rollers for holding the coins stacked by the coin stacking means therebetween and rotating them around their longitudinal axis to wind a wrapping material around a circumferential surface of the coins stacked by the coin stacking means, wrapping roller driving means for driving the wrapping rollers, a pair of crimp claw means for approaching the coins stacked by the coin stacking means and around which the wrapping material is wound from upper and lower locations and crimping upper and lower edge portions of the wrapping material, crimp claw means driving means for moving the pair of crimp claw means, and driving speed control means for controlling the rotatable disk driving means, the transporting belt driving means, the wrapping roller driving means and the crimp claw means driving means based on the denomination of the coins set by the denomination setting means, thereby controlling the rotating speed of the rotatable disk, the driving speed of the transporting belt means, the rotating speed of the wrapping rollers and the moving speed of the crimp claw means driving means.

2. A coin wrapping machine in accordance with claim 1 wherein the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are smaller than a reference coin having a predetermined diameter and a predetermined thickness.

3. A coin wrapping machine in accordance with claim 1 wherein the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are larger than a reference coin having a predetermined diameter and a predetermined thickness.

4. A coin wrapping machine in accordance with claim 2 wherein the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are larger than a reference coin having a predetermined diameter and a predetermined thickness.

5. A coin wrapping machine in accordance with claim 1 wherein the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are thicker than a reference coin having a predetermined diameter and a predetermined thickness.

6. A coin wrapping machine in accordance with claim 2 wherein the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are thicker than a reference coin having a predetermined diameter and a predetermined thickness.

7. A coin wrapping machine in accordance with claim 3 wherein the driving speed control means is adapted to control the rotatable disk driving means and the transporting belt driving means so that the rotating speed of the rotatable disk and the driving speed of the transporting belt means are lower than reference driving speeds when coins of the denomination set by the denomination setting means are thicker than a reference coin having a predetermined diameter and a predetermined thickness.

8. A coin wrapping machine in accordance with claim 1 wherein the driving speed control means is adapted to control the rotatable disk driving means and the transporting belt driving means so that the rotating speed of the rotatable disk and the driving speed of the transporting belt means are higher than reference driving speeds when coins of the denomination set by the denomination setting means are thinner than a reference coin having a predetermined diameter and a predetermined thickness.

9. A coin wrapping machine in accordance with claim 2 wherein the driving speed control means is adapted to control the rotatable disk driving means and the transporting belt driving means so that the rotating speed of the rotatable disk and the driving speed of the transporting belt means are higher than reference driving speeds when coins of the denomination set by the denomination setting means are thinner than a reference coin having a predetermined diameter and a predetermined thickness.

10. A coin wrapping machine in accordance with claim 3 wherein the driving speed control means is adapted to control the rotatable disk driving means and the transporting belt driving means so that the rotating speed of the rotatable disk and the driving speed of the transporting belt means are higher than reference driving speeds when coins of the denomination set by the denomination setting means are thinner than a reference coin having a predetermined diameter and a predetermined thickness.

11. A coin wrapping machine in accordance with claim 1 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

12. A coin wrapping machine in accordance with claim 2 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

13. A coin wrapping machine in accordance with claim 3 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

14. A coin wrapping machine in accordance with claim 4 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

15. A coin wrapping machine in accordance with claim 5 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

16. A coin wrapping machine in accordance with claim 6 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

17. A coin wrapping machine in accordance with claim 7 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

18. A coin wrapping machine in accordance with claim 8 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

19. A coin wrapping machine in accordance with claim 9 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

20. A coin wrapping machine in accordance with claim 10 wherein when coins of the denomination set by the denomination setting means are polygonal, the driving speed control means is adapted to control the rotatable disk driving means and the transporting belt driving means so that the rotating speed of the rotatable disk and the driving speed of the transporting belt means are lower than reference driving speeds and to control the wrapping roller driving means and the crimp claw means driving means so that the rotating speed of the wrapping rollers and the moving speed of the crimp claw means are lower that reference speeds.

* * * * *